US005106228A

United States Patent [19]

Vivier

[11] Patent Number: 5,106,228

[45] Date of Patent: Apr. 21, 1992

[54] MULTICOURSE SURFACING FOR PAVEMENT

[75] Inventor: Maurice Vivier, Paris, France

[73] Assignee: Enterprise Jean Lefebvre, Neuilly sur Seine Cedex, France

[21] Appl. No.: 647,920

[22] Filed: Jan. 30, 1991

[30] Foreign Application Priority Data

Feb. 2, 1990 [FR] France ..... 90 01240

[51] Int. Cl.[5] ..... E01C 5/12

[52] U.S. Cl. ..... 404/82; 404/31; 404/81

[58] Field of Search ..... 404/31, 32, 82, 81; 524/68, 69

[56] References Cited

U.S. PATENT DOCUMENTS

| | | | |
|---|---|---|---|
| 4,151,025 | 4/1979 | Jacobs | 404/31 X |
| 4,362,586 | 12/1982 | Uffner et al. | 404/31 X |
| 4,545,699 | 10/1985 | Uffner et al. | 404/31 |
| 4,728,683 | 3/1988 | Smits et al. | 404/31 X |
| 5,026,609 | 6/1991 | Jacob et al. | 404/31 |

*Primary Examiner*—Stephen J. Novosad

*Attorney, Agent, or Firm*—Dressler, Goldsmith, Shore, Sutker & Milnamow, Ltd.

[57] ABSTRACT

The invention relates to a multicourse surfacing for pavements, in particular for pavements whose base courses are cracking, and to a method for the production of this surfacing. The surfacing according to the invention, comprising an asphaltic membrane applied to the base course of the pavement and a waring course or binder course, comprises, between the asphaltic membrane and the wearing course or binder course, at least one layer of cold mix. The method comprises applying successively to the base course of the pavement, optionally covered with a primer layer:

a layer of asphaltic binder, by cold spreading, a layer of a composition containing an asphaltic binder and a granular material, a wearing course or binder course. These surfacings are particularly effective for slowing the ascent into the wearing course of cracks forming in the base course of the pavement.

11 Claims, 2 Drawing Sheets

MULTICOURSE SURFACING FOR PAVEMENT

The present invention belongs to the field of pavement surfacing, particularly for pavements whose base courses are cracking.

The shrinkage cracking of pavements having a semi-rigid base course represents a handicap to the development of this type of structure, whose technical and economic merits are otherwise not in doubt. This undesirable phenomenon occurs, in particular, in the case of pavements having base courses treated with hydraulic binders and a wearing course comprising hot mix.

Various solutions have been envisaged with a view to delaying or preventing the cracking caused by thermal shrinkage of the base courses from ascending into the upper courses of the pavement.

A first improvement is to interpose an asphaltic membrane, having a thickness of 2 to 3 mm, between the wearing course and the base. In the case of a new pavement, the base is formed of a sand-gravel mixture treated with hydraulic binders. In the case of an existing cracked pavement comprising sand-gravel mixtures treated with hydraulic binders, the base is formed by the existing surfacing.

The asphalts used for the asphaltic membrane may be either pure asphalts or asphalts modified by the addition of macromolecular substances.

A disadvantage of this type of method is that, when the first carpet of hot mix is laid over the asphaltic membrane, even with the addition of sand, the membrane melts and percolates down to the base of this carpet, so that its thickness is greatly reduced, to the point of disappearing virtually entirely if the temperature of the mix is excessive. The ability to slow the ascent of the cracks is then considerably reduced, since a carpet of mix, even highly enriched with asphaltic binder at its base, is clearly less plastic than a layer of pure binder.

An additional improvement was then provided by the application, between the abovementioned asphaltic membrane and the wearing course, or a binder course, of a membrane produced by unrolling a nonwoven or by in situ entanglement of synthetic yarns added in a very high quantity. This method has made it possible to slow the ascent of the cracks, but its application is difficult and consequently costly.

The present inventors have now discovered a new means of making it possible to prevent the reverse percolation of the binder forming the asphaltic membrane during the application of the hot mix forming the wearing course.

The present invention relates to a novel multicourse surfacing for pavements, particularly for pavements whose base courses are cracking.

The invention likewise relates to a method of producing this surfacing.

Figure 1:
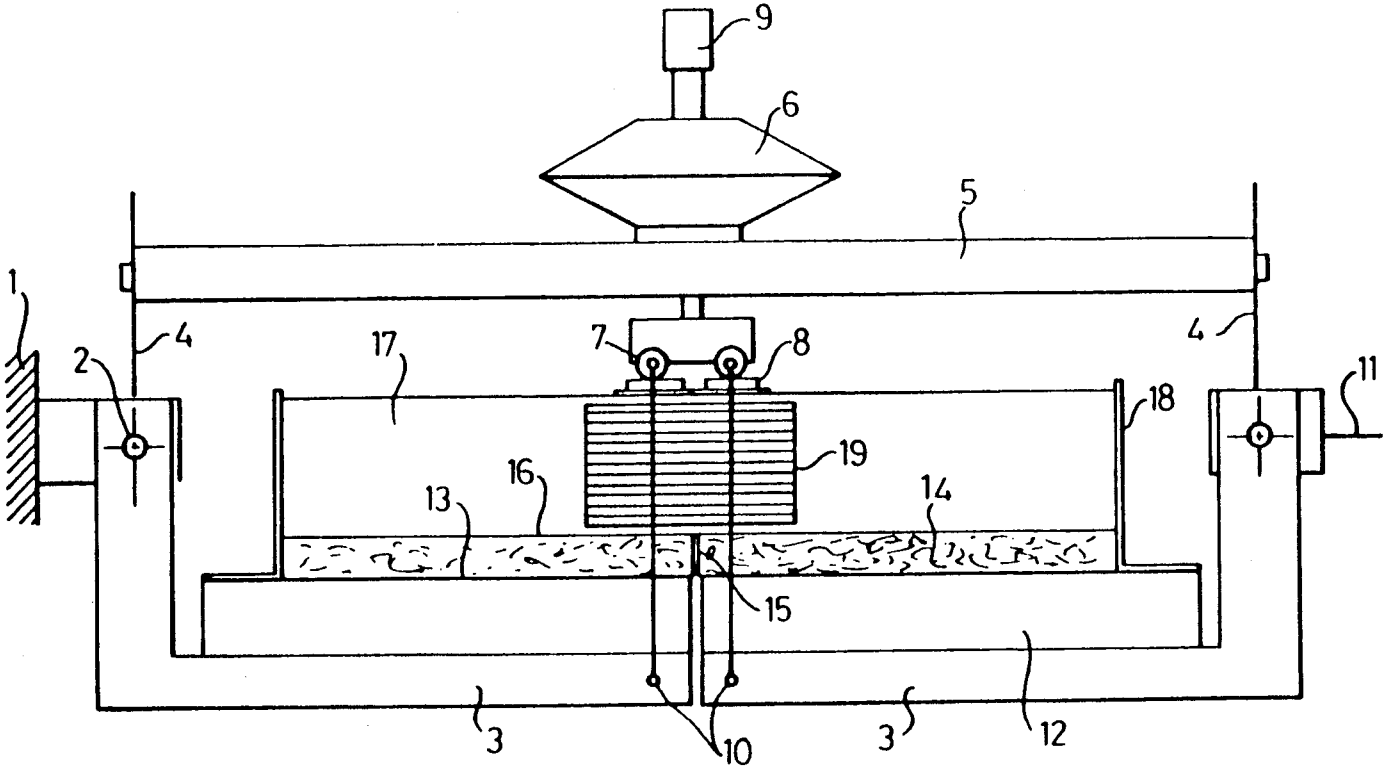
FIG. 1 shows a test device used in present invention.

The multicourse surfacing according to the invention comprises an asphaltic membrane applied to the base course of the pavement, and a wearing course or a binder course. It furthermore comprises at least one course of cold mix, between the asphaltic membrane and the wearing course or a binder course. Naturally, if the surface condition of the base so requires, a layer of would be applied to said base before the asphaltic membrane is applied.

The layer of cold mix is formed by an asphaltic binder and the granular material whose maximum particle size remains below about 10 mm.

The granular material is preferably a crushed sand, and more particularly a 0/6, 0/4 or 0/2 sand. The thickness of the layer of cold mix is between 3 and 12 mm. It is substantially a function of the particle size range of sand. Thus, for a 0/2 sand, the thickness is of the order of 3 to 5 mm; for a 0/4 sand, it is 5 to 7 mm; for a 0/6 sand, it is 7 to 10 mm.

The layer of cold mix may be a single layer. It may also be a double layer.

The asphaltic binder essentially contains an asphalt.

The asphalt is selected from among the pure asphalts, preferably from among asphalts of grades 60/70, 80/100 and 180/220.

The asphalt used may be asphalt modified by the addition of thermoplastic copolymers, either by direct hot mixing of pure asphalt with copolymer, or by indirect cold mixing of pure asphalt emulsion with an aqueous dispersion of copolymer at the time of production of the mix to be poured.

Use will preferably be made of ethylene/vinyl acetate (EVA) or triblock styrene/butadiene/styrene (SBS) or ethylene methacrylate (EMA) copolymers.

However, use can likewise be made of diblock styrene/butadiene rubber (SBR) copolymers and acrylic copolymers, and of various mixtures of these copolymers.

The copolymer content is at most equal to about 5% by weight. The addition of such copolymers results in less rejection on application, improved bonding between the binder and the granular material, increased resistance to salt water, reduced sensitivity to heat and cold, greater cohesion and better deformability.

A mineral filler may, if necessary, supplement the particle size range of the granular materials, such as for example a powder of ground rock, preferably calcareous rock, or cement, or fibers of natural or artificial rock. The content of mineral filler is less than 10%.

In an alternative embodiment of the invention, the asphaltic binder additionally contains synthetic fibers. The fibers used are organic synthetic fibers which are ultrafine (a few decitex) and relatively long (4 to 8 mm). They are selected as a function of the modulus of elasticity of the material of which they are formed, in order to obtain a fibrous mix whose plasticity is compatible with that of the base on which it will be applied. Fibers having a low modulus of elasticity will be used for the most plastic pavements.

The proportion of fibers is advantageously between 0.05 and 3% by weight. This proportion may be very low but, bearing in mind the extreme fineness of these fibers, their number per square meter of cord mix is considerable, as is the length of the network which they comprise.

The asphaltic membrane applied to the base may be a simple membrane, essentially comprising a pure asphalt.

Preferably, this membrane comprises an asphalt modified by the addition of a macromolecular compound, for example an ethylene/vinyl acetate (EVA) copolymer or a styrene/butadiene/styrene (SBS) poly. Such membranes are described, for example, in French Patent 2,183,618 and its certificate of addition 2,268,113. The maximum content of copolymer is imposed by the limit of viscosity of the modified asphalt, up to which it flows from a heating and heat-insulated surfacing boom while remaining at a temperature below the degradation temperature of the copolymer.

By way of example of a composition which can be used to prepare an asphaltic membrane, the following composition may be mentioned:

| | |
|---|---|
| asphalt 80/100 about | 80% (by weight) |
| EVA copolymer | <20% (by weight) |
| dope | 0-3% (by weight) |

The thickness of the asphaltic membrane is advantageously between 1 and 5 mm.

It is appropriate to remember at this stage that the precise composition of the asphaltic membrane, and its method of application, are not in the least critical in the context of the present invention. Thus, the asphaltic membrane may be applied hot, or alternatively may be spread cold in the form of an asphaltic emulsion.

The asphaltic membrane may advantageously be covered, in a conventional manner using a sanding operation, with fine particles, for example with slate powder or sintering sand.

It will however be noted that such a sanding or gravelling operation is not necessary, since it is entirely possible to run the cold-mix spreader truck directly on said provided that the types of the truck are continually wetted to prevent their adhesion to the membrane.

The precise nature of the wearing or binder course is not critical. These courses are produced, in a manner known per se, for example in the form of a surface coating, a hot mix or a cold mix. In the particular case of a hot-mix top layer, the layer of cold mix forms a thermal and mechanical screen which acts to counter the reverse percolation of the membrane into this mix.

The wearing course or binder course may likewise be formed by a cold mix containing a modified asphalt to which synthetic fibers may or may not have been added.

This surfacing according to the present invention may be applied to any pavement base. It is particularly useful for pavements whose base is subject to cracking, whatever may be the origin of the cracking. In particular, the cracks in question may be active cracks originating from a phenomenon of thermal shrinkage. The base may, for example, be formed by slabs of concrete separated by expansion joints. The surfacing is particularly useful for pavements having a semi-rigid base course which has been treated with hydraulic binders, and for cement concrete pavements.

The method of producing a multicourse surfacing according to the invention comprises applying successively to the pavement a layer of asphaltic binder, spread hot or alternatively cold in the form of an emulsion, a layer of cold mix, then a wearing course or binder course. Each of these courses is applied by conventional methods.

The present invention is illustrated in a nonlimiting manner by the examples which follow.

Examples 1 and 2 are examples of preparation of compositions intended to form the cold mix layer.

EXAMPLE 1

The asphaltic binder used was Mobilplast®, marketed by the applicant, containing 95% by weight of 80/100 emulsifiable asphalt and 5% by weight of a 33/45 EVA copolymer.

An emulsion was prepared, having the following composition, expressed in kg:

| | |
|---|---|
| Mobilplast ® binder | 600 |
| emulsifier | 9 |
| HCl (d-1, 19) | 2.15 |
| Water | 400 |

The characteristics of this emulsion are as follows:

| | |
|---|---|
| - pH | 2 to 3.5 |
| - Engler viscosity | 2 to 6 degrees |
| - oversize on | |
| - 0.630 mm screen | <0.1% |
| - 0.160 mm screen | <0.25% |
| - LCPC breaking index | >160 |
| - median diameter | 2 to 4 μm |
| - sedimentation after 7 days | <5% |

The composition intended to form the layer of cold mix was prepared by combining the following mixture, in which proportions are expressed in parts by weight:

| | |
|---|---|
| - initial mixture | 100 |
| - crushed sand 0/2 mm | 99% by weight |
| - CPA 55 cement | 1% by weight |
| - water for wetting | 7.5 |
| - 60% emulsion | 25 |
| - pure dope | 0.2 |
| - polyester fibers | 0.2 |
| - residual binder | 15 |

EXAMPLE 2

The emulsion prepared in Example 1 was used to prepare the following composition, in the same manner as in Example 1:

| | |
|---|---|
| - mineral mix | 100 |
| - crushed sand 2/4 mm | 34% by weight |
| - crushed sand 0/2 mm | 65% by weight |
| - CPA 55 | 1% by weight |
| - water for wetting | 8 |
| - 60% emulsion | 20 |
| - pure dope | 0.2 |
| - polyester fibers | 0.2 |
| - residual binder | 12 |

EXAMPLE 3

Flexure shrinkage tests

Flexure shrinkage tests were carried out on a specimen reproducing a multi-course surfacing according to the invention and on specimens reproducing control surfacings.

The test comprises monitoring the rate of ascent of a crack through the various surfacings.

Each specimen, representing the base + surfacing complex, is subjected under constant temperature conditions (5° C.) to two simultaneous stresses:

a continuous, slow longitudinal traction, simulating the thermal shrinkage, a cyclical vertical flexure, at a frequency of 1 Hz, simulating the traffic.

The propagation of the crack is monitored with the aid of a network of conducting wires.

Under these conditions, the test makes it possible to estimate various characteristics associated with the efficiency of the composite being studied (appearance of the crack, rate of propagation, time for complete cracking of the composite).

A diagram of the machine used is shown in FIG. 1. In FIG. 1:

(1) designates the frame of the machine,
(2) designates the pivot axes of the L-shaped plates (3),
(4) designates the flexible sheets,
(5) designates the upper reaction crosspiece of the adjustable-travel pneumatic jack (6),
(7) designates the rollers,
(8) designates the support plates,
(9) designates the adjustment of the travel of the pneumatic jack (6),
(10) designates the connecting rods for transmitting sag to the L-shaped plates (3),
(11) designates the screw traction jack and the ball circulation,
(12) designates the base plates bolted to the L-shaped plates (3) (variable thicknesses, depending on the thickness of the specimens),
(13) designates the bonding of the specimen to the base plates (12),
(14) designates the 1.5-cm layer of precracked sulphur-containing asphalt concrete simulating the cracked former pavement,
(15) designates the precracking (card sheet),
(16) designates the possible interface (geotextile, membrane, coupling),
(17) designates the body of the specimen, in other words the wearing course,
(18) designates the bonded metal foil preventing the vertical movements of the ends of the specimen while permitting horizontal movement (relative to the base plate),
(19) designates the crack detection network.

The specimens to be tested were prepared on the compaction table in sheets of 400×600×e (mm), e being the thickness. They comprise the following layers:

a—Precracked base course of sulphur-containing asphalt-impregnated sand, 15 mm thick;

b—the system to be studied, if any;

c—a standard wearing course of 0/10 reference asphaltic concrete, designated hereinafter BB 0/10, generally 6 cm thick and conforming to the following formula:

35% 0/2 Pont de Colonne sand
22% 2/6 sand
40% 6/10 sand
3% limestone fines
6.3% 60/70 asphalt.

Each sheet is sawn to provide three test specimens of dimensions 560×110×e. Each specimen is provided with a network of conducting wires forming part of the crack monitoring system. The specimen is then bonded to two (aluminum) half-sheets and attached to the machine in accordance with the diagram in FIG. 1.

For a more detailed description of the method and of the measuring device used, refer to: "Reflective Cracking in Pavement, Assessment and Control", published by the Conference held at Liege in Belgium on 8, 9 and 10 May 1989, reporting the lecture by J.H. Vecoven, L.R.P.C. of Autun, entitled : "Method of studying systems restricting the ascent of cracks in pavements".

A base + complex surfacing composite according to the invention was studied as part of this experiment, in comparison to three control composites. Their compositions are indicated in Table I below.

TABLE I

| Sample no | Nature of the layers | Thickness |
|---|---|---|
| 1 | BB 0/10 | 4 cm |
| 2 | BB 0/10 | 8 cm |
| 3 | Sand mix | 2 cm |
| | BB 0/10 | 6 cm |
| 4 | asphaltic membrane | 0.5 mm |
| | cold mix 0/4 | |
| | (example 2) | 1.2 cm |
| | BB 0/10 | 6 cm |

The behavior of the systems to be tested during the test may be broken down as follows:

Period without cracking (from the start to the time of initiation);

Appearance of the crack at the bottom of the layer (initiation time);

Period of ascent of the crack;

Rapid fracture of the system (time of total cracking)

Figure 2:
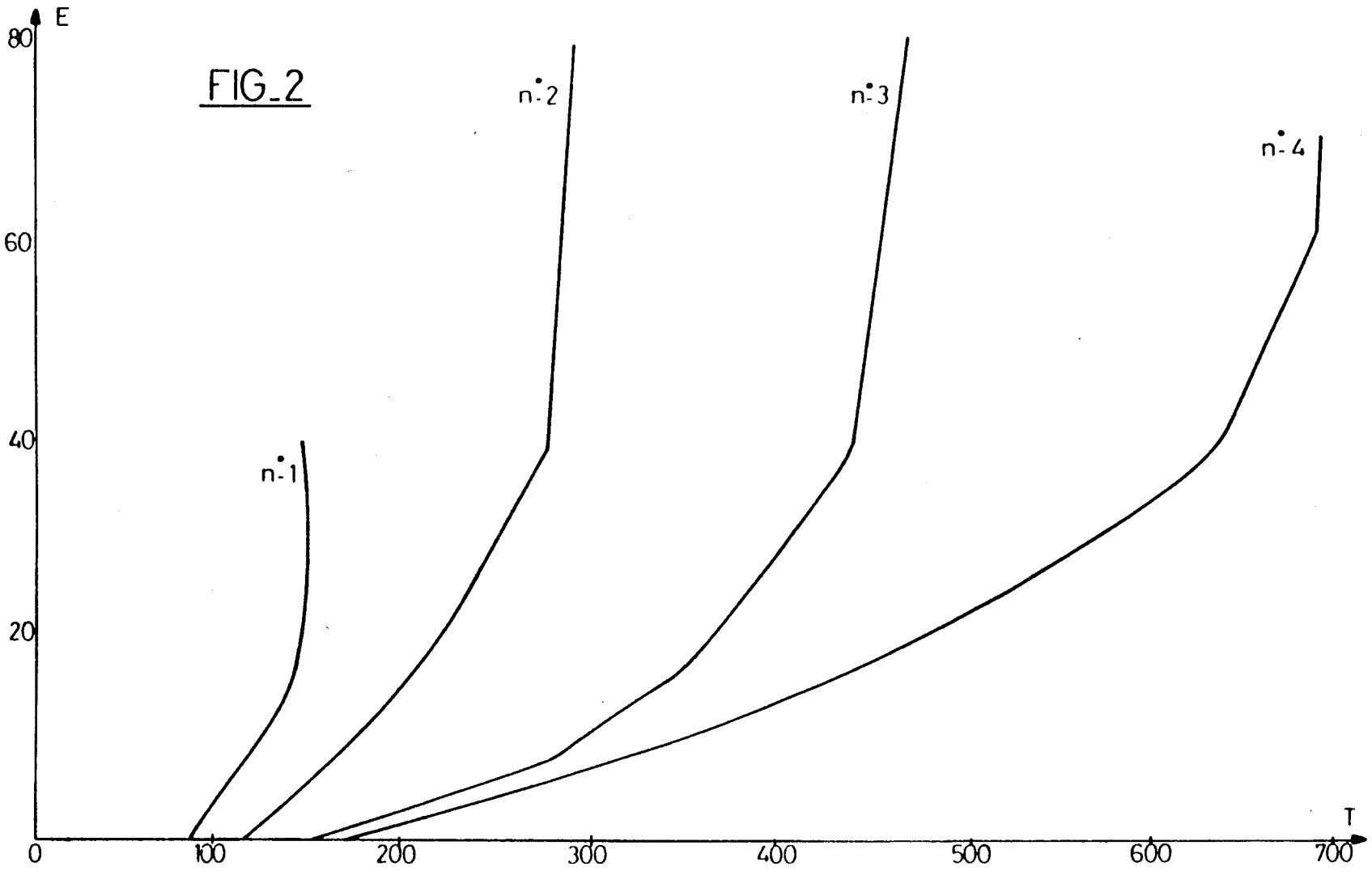
FIG. 2 show a graph of the results of the tested specimens of the invention.

The results, for each system studied, are shown in the graph in FIG. 2 which illustrates the progression of the crack as a function of time. The cracked thickness E, in mm, is plotted as the ordinate. The cracking time T, in min, is plotted as the abscissa.

Each curve corresponds to the average behavior of two specimens. The number allocated to each curve is the number of the corresponding sample.

The test, although simulating the stresses to which the pavement is subjected, can only be interpreted by establishing comparisons with known control systems. The controls used in this study are 60/70 asphaltic concretes bonded directly to their cracked base (samples and curves nos. 1 and 2) and a system of 60/70 asphaltic concrete +80/100 asphaltic-rich sand also bonded to its base (sample and curve no. 3).

When the curves in FIG. 2 are considered, it is noted that the initiation times are quire similar. The controls and system according to the invention seem to have a relatively similar behavior during that stage.

On the other hand, when the first stage of the propagation of the crack is considered (the first two centimeters), the mean rates of cracking are substantially different:

Two-layer method: 6 mm/h

Membrane-grouting method: 4 mm/h

When the system according to the invention is compared with the control systems, it is apparent that the systems according to the invention possess better resistance to the propagation of cracking.

I claim:

1. A multicourse surfacing for a pavement having a base course which is undergoing cracking, consisting essentially of an asphaltic membrane applied to the base course and a wearing course or binder course, comprising, between the asphaltic membrane and the wearing coarse or binding course, at least one layer of cold mix.

2. The multicourse surfacing as claimed in claim 1, wherein the asphaltic membrane is formed of pure asphalt or of asphalt modified with thermoplastic copolymers.

3. The multicourse surfacing as claimed in claims 1 or 2, wherein the layer of cold mix contains an asphaltic binder and a granular material whose maximum particle size is less than about 10 mm.

4. The multicourse surfacing as claimed in claim 3, wherein the granular material is selected from among crushed sands.

5. The surfacing as claimed in claim 4 wherein the asphaltic binder contains a pure asphalt.

6. The surfacing as claimed in claim 3 wherein the asphaltic binder contains an asphalt modified by the addition of at least one copolymer.

7. The surfacing as claimed in claim 6, wherein the copolymer is selected from among ethylene/vinyl acetate copolymers, triblock styrene/butadiene/styrene copolymers, diblock styrene/butadiene rubber copolymers (SBR), acrylic copolymers and mixtures thereof.

8. The surfacing as claimed in claims 1 or 2 wherein the layer of cold mix contains synthetic fibers.

9. The surfacing as claimed in claims 1 or 2 which comprises a primer layer between the base and the asphaltic membrane.

10. A method of producing a pavement surfacing as claimed in claims 1 or 2, intended to slow down the propagation of cracks from the base courses through the surfacing, which comprises applying successively to the base course of the pavement, optionally covered with a primer layer;

a layer of asphaltic binder, by cold pouring, a layer of a composition containing an asphaltic binder and a granular material, a wearing course or binder course.

11. The method as claimed in claim 10, wherein the wearing coarse or binder course is applied hot.

* * * * *